United States Patent [19]

Edwards

[11] 4,040,537

[45] Aug. 9, 1977

[54] DOUBLE-WALLED CUP CONSTRUCTION FOR INTERLOCKING IN NESTED STACKS TO SEAL A FOOD CONCENTRATE BETWEEN ADJACENT CUPS

[75] Inventor: Bryant Edwards, Clarendon Hills, Ill.

[73] Assignee: Illinois Tool Works Inc., Chicago, Ill.

[21] Appl. No.: 702,906

[22] Filed: July 6, 1976

Related U.S. Application Data

[63] Continuation of Ser. No. 536,840, Dec. 27, 1974, abandoned.

[51] Int. Cl.[2] ..... B65D 21/02; B65D 25/18; B65D 85/72

[52] U.S. Cl. ..... 220/9 R; 206/219; 206/520; 229/1.5 B

[58] Field of Search ..... 206/219, 519, 520; 229/1.5 B; 220/9 R

[56] References Cited

U.S. PATENT DOCUMENTS

| | | | |
|---|---|---|---|
| 3,091,360 | 5/1963 | Edwards | 206/520 |
| 3,372,830 | 3/1968 | Edwards | 220/9 R |
| 3,443,714 | 5/1969 | Edwards | 220/9 R |
| 3,512,677 | 5/1970 | Kovac | 229/1.5 B |

*Primary Examiner*—George E. Lowrance
*Attorney, Agent, or Firm*—Olson, Trexler, Wolters, Bushnell & Fosse, Ltd.

[57] ABSTRACT

A plastic cup is provided of the thin wall variety having inner and outer spaced walls with an insulating air space therebetween. Successive cups in a telescoped stack seal effectively together so that a food concentrate or the like placed in the bottom of each cup will be protected against contamination and spoilage. To this end, the cups are provided with stacking rings and cylindrical sealing surfaces whereby a certain degree of movement between adjacent telescoped cups is permissible without allowing the entrance of air into the space between such adjacent cups. The inner and outer walls of each cup are spaced apart in the stacking and sealing ring area to allow pivotal movement of an inner cup wall with regard to its corresponding outer cup wall, whereby a telescoped stack of nested cups can flex, i.e., the axis of the stack can go from straight to arcuate, without breaking the seal between adjacent telescope cups which would lead to contamination or spoilage of the food ingredient therein.

13 Claims, 9 Drawing Figures

20a
20b
80
84
66
64
68
46
48
70
71
40
38
36
34
74
76
78
52
56
54
6
9
8
30
32
26
28
60
62
24
22
42
44
50
58

DOUBLE-WALLED CUP CONSTRUCTION FOR INTERLOCKING IN NESTED STACKS TO SEAL A FOOD CONCENTRATE BETWEEN ADJACENT CUPS

This is a continuation of application Ser. No. 536,840, filed Dec. 27, 1974, now abandoned.

BACKGROUND OF THE INVENTION

Disposable cups have long been known. For many years such cups were made of paper treated with wax or the like. Such cups have seams which are prone to leak, and also provide an undesirable taste of their own. Accordingly, seamless plastic cups have come into widespread use, particularly in vending machines. Such cups are typically produced by a plug-assisted blow molding process of a thermoplastic material, polystyrene being one preferred example. Pioneering and commercially successful such cups are shown in my own prior U.S. Pat. Nos. 3,091,360 and 3,319,213, for example. The cups in the two patents just noted are provided with stepped sidewall portions providing relatively inefficient heat transfer from the cup contents to the fingers of a user. However, there are instances in which the cup contents may be so hot that it is not very comfortable to hold such in the fingers for an extended period of time.

For some types of comestibles automatically vended in plastic cups it is a simple matter to provide two or more sources of liquid to provide desired flavors, etc., soft drinks being a common example. In other instances it is desired to use a dried powder or the like, such as for coffee, hot chocolate, chicken soup, etc. Powders are not so readily handled in vending machines. Accordingly, it has heretofore been proposed to provide a stack of plastic cups in which a food concentrate or the like is stored in the bottom of each cup, the next above adjacent cup providing a seal to protect the food concentrate, see U.S. Pat. No. 3,512,677. It also is known to provide cups with a double-spaced wall construction providing an air space for insulation, see for example U.S. patent application Ser. No. 340,122, filed Mar. 12, 1973 by Robert H. Day. The present invention relates to a cup specifically of the last mentioned type.

OBJECTS AND SUMMARY OF THE DISCLOSURE

It is the principal object of the present invention to provide a double-walled, thin-wall cup having advantages over the prior art, particularly in the provision of novel structure to insure against breaking of the seal between adjacent telescoped cups, whereby a food concentrate supplied in the bottom of each cup is protected against contamination and deterioration.

More particularly, in accordance with the present invention the seal between the outer cup of one double-walled cup and the inner cup of the next subjacent such cup telescoped therewith is a vertical cylindrical wall-to-wall seal, whereby a certain degree of vertical movement between adjacent cups does not break the seal. Notwithstanding the fact that there is substantially no lateral space between such cylindrical sealing surfaces, axial resiliency in a stack (heretofore recognized as a desirable feature) is obtained in that the inner cup member of each double-walled cup is anchored at the rolled rim of the outer cup member and hangs substantially freely within the outer cup member.

Each of the inner and outer cup members has only one undercut, thereby simplifying stripping of such cup members from their mold. The undercut in the outer cup member is deeper than the undercut in the inner cup member, thereby preventing the interlocking shoulders so formed from disturbing the cylindrical wall-to-wall seal heretofore mentioned. the undercut in the outer cup member is near the bottom wall of the outer cup member with the sealing surface immediately adjacent thereto whereby the seal is placed close to the ingredient storage space, and whereby a high stack of interlocked cups in telescoped relation may be bowed as in transport or storage without breaking the seal between adjacent cups, the inner cup member being deformable to this end. Sufficient clearance is provided in the area of the inner cup undercut to permit such deformation and also to permit outward flexing of the inner cup member when adjacent double-wall cups are interlocked. Finally, the undercut of the inner cup member is interrupted, thereby providing air vents facilitating interlocking of adjacent telescoped double-walled cups.

DESCRIPTION OF THE DRAWINGS

The invention will best be understood from the following description when taken in accompaniment with the drawings wherein.

DETAILED DESCRIPTION OF THE PREFERRED EMBODIMENT

Figure 1:
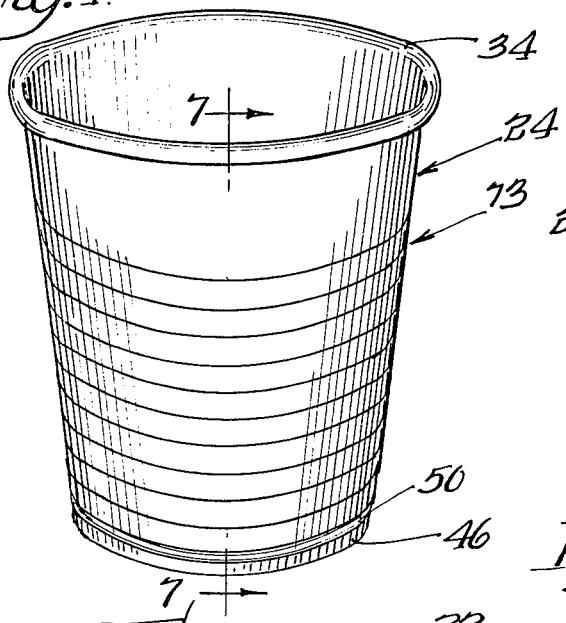
FIG. 1 comprises a perspective view of a double-walled, thin-walled plastic cup constructed in accordance with the present invention.
Figure 2:
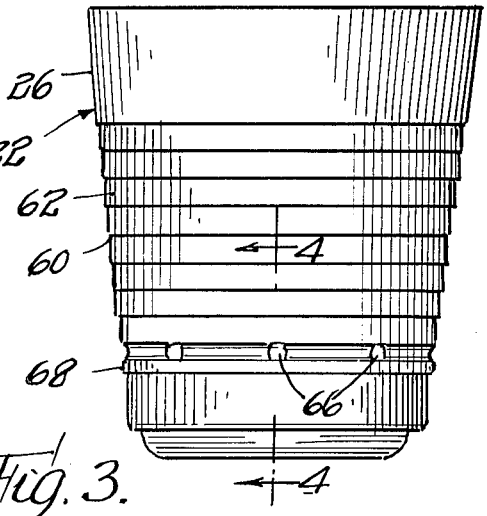
FIG. 2 comprises a side view of the inner cup member of the cup shown in FIG. 1.
Figure 3:
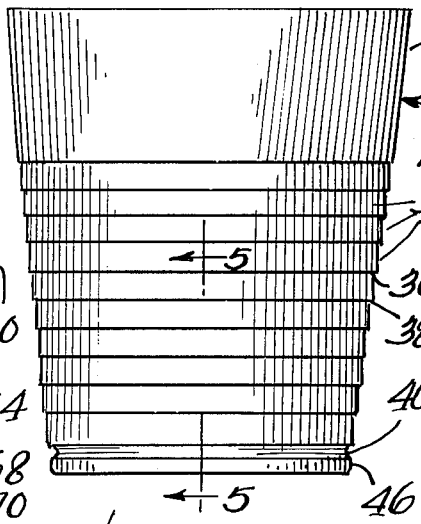
FIG. 3 comprises a side view of the outer cup member of such cup.
Figure 4:
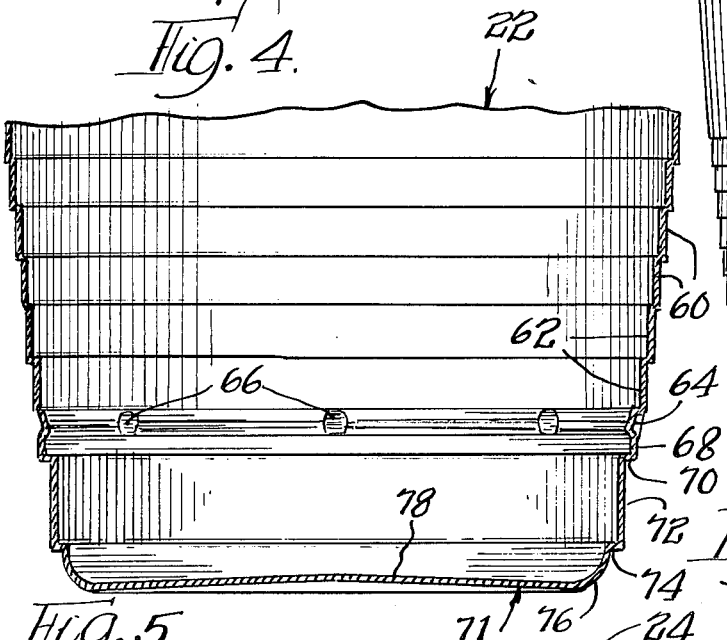
FIG. 4 comprises a vertical section through the inner cup member on an enlarged scale as taken substantially along the line 4—4 in FIG. 2.
Figure 5:
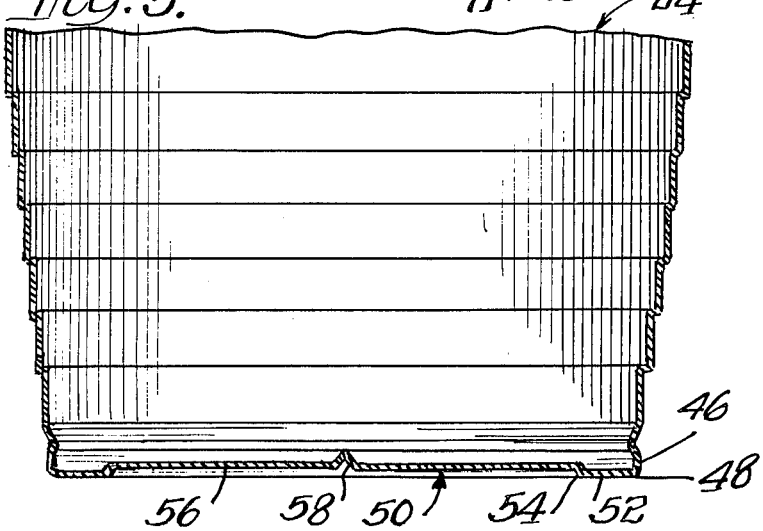
FIG. 5 comprises a vertical section on an enlarged scale taken substantially along the line 5—5 in FIG. 3.
Figure 6:
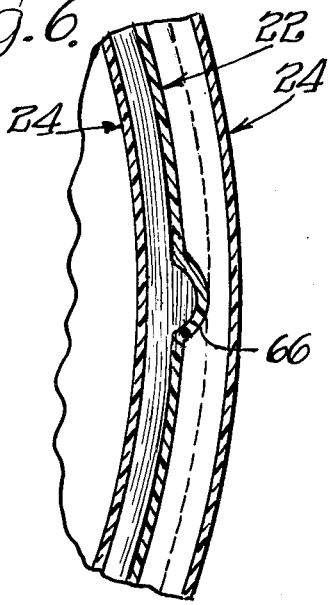
FIG. 6 is a greatly enlarged horizontal section through a stack of such cups as taken substantially along the line 6—6 in FIG. 9.
Figures 7, 8, 9:
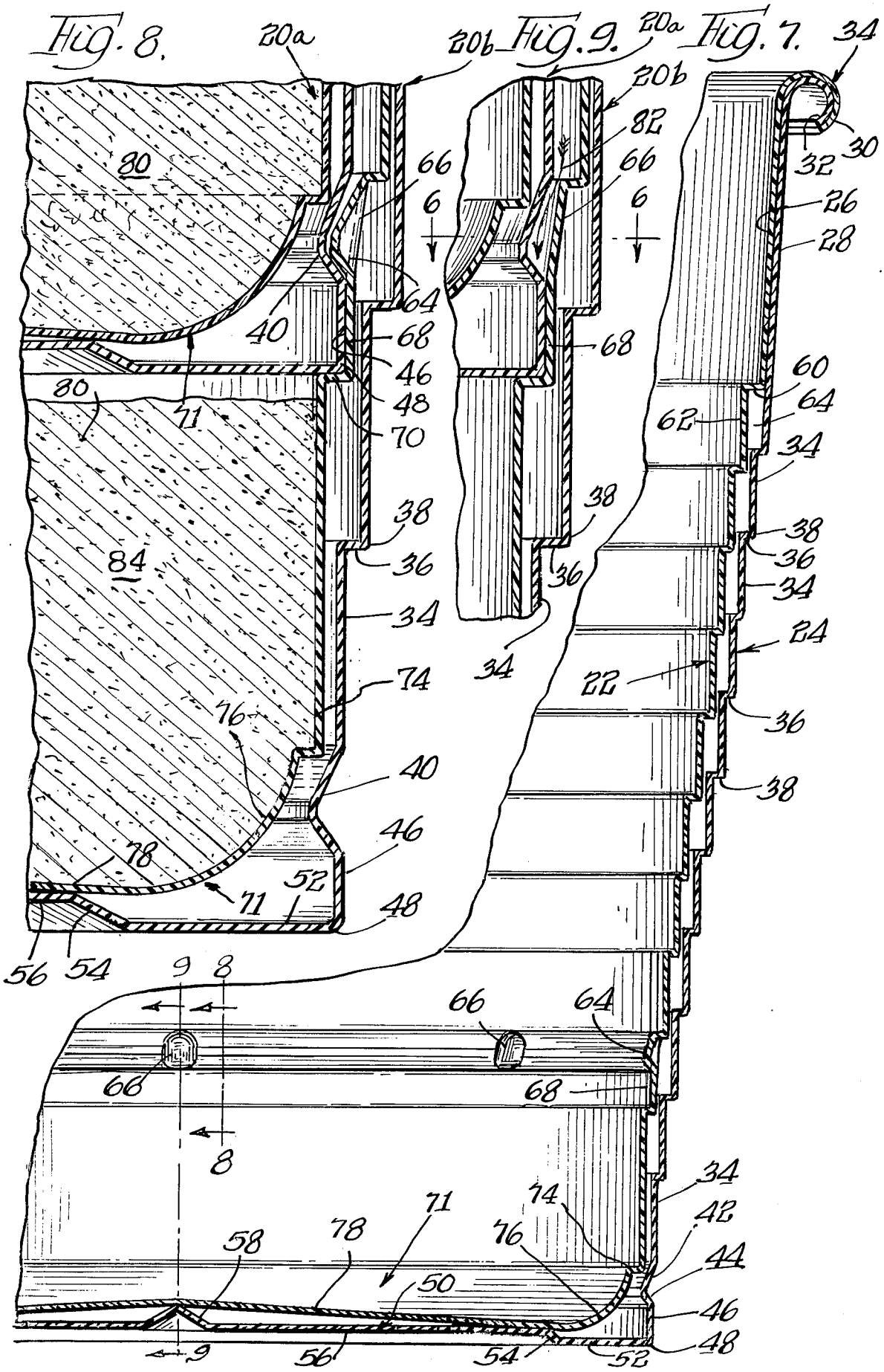
FIG. 7 is an enlarged, fragmentary vertical sectional view through the cup of the present invention as taken substantially along the line 7—7 in FIG. 1.
FIG. 8 is a further enlarged fragmentary vertical sectional view through a stack of such cups in telescoped relation as taken substantially along the line 8—8 in FIG. 7.
FIG. 9 is a sectional view similar to FIG. 8, being a smaller section, taken substantially along the line 9—9 in FIG. 7.

Turning now in greater particularity to the drawings, and first to FIG. 1, there will be seen a cup 20 constructed in accordance with the principles of the present invention. The cup is double-walled, comprising an inner cup member 22 and an outer cup member 24. In the main the sidewalls of these two cup members are spaced apart as will be brought out hereinafter. However, adjacent the top thereof the inner cup member 22 has an upwardly opening, outwardly diverging a cylindrical upper wall portion 26 in firm surface engagement with an outer cup corresponding upper wall section 28 (FIG. 7). The upper margins of the inner and outer cup members, at 30 and 32 respectively, are rolled together to form a rolled rim 34 securing the inner and outer cup members together.

From the bottom of the upper wall portion 28 the outer cup member progresses downwardly and convergingly inwardly in a series of cylindrical rings 34 and inwardly directed flanges 36 forming external shoulders 38 therewith, nearly to the bottom of the outer cup member. The outer shoulders 38 form a substantially line contact with the thumb and fingers, thus affording poor heat transfer, as is known from my earlier patents.

Below the lowermost cylindrical ring section 34 there is provided an indentation or undercut 40 of generally triangular section, having an inwardly directed frustoconical wall section 42 and an outwardly directed frustoconical wall section 44 of slightly greater extent. From the bottom edge of the indented or undercut locking section 40 there is a cylindrical surface 46 extending down to a right angle shoulder 48 forming the lower limit of the outer cup member. The outer cup member is provided with an integral floor or bottom 50 including a substantially planar ring 52 extending in from the shoulder 48 and joined at an upwardly offset section 54 to a substantially flat central floor section 56 having an upward central conical projection 58. As will be understood, the entire outer cup member is of integral construction, and most conveniently is formed in a plug-assisted thermoforming operation of suitable thin, thermoplastic material, polystyrene being one preferred example.

The inner cup member 22 is generally similar to the outer cup member, but is distinguished therefrom in significant respects. From the lower edge of the upper wall portion 26 the inner cup member proceeds downwards in a series of horizontal offsetting rings 60 and vertical cylindrical ring sections 62. As is best seen in FIG. 7 the lower portion of a cylindrical ring section 62 of the inner cup member nearly contacts the upper portion of an adjacent cylindrical ring section 34 of the outer cup member, there being only a rather small space in between at these specific areas. However, between these areas are rather large air spaces 64 forming excellent insulation to prevent heat transfer outwards from the contents of the cup to the fingers of one holding it. It is apparent that these air spaces 64 will continue to exist even though portions of the outer wall of the outer cup member might be flexed inwardly slightly to engage immediately adjacent areas of the inner cup member, i.e., the upper portions of the rings 34 against the lower portions of the rings 62. As will now be apparent the vertical height of the various rings 34 and 62 is all substantially equal.

At the bottom of the lowermost ring 62, and toward the lower extremity of the inner cup member, there is an inwardly directed or undercut locking ring section 64 generally similar in shape to the outer cup member locking ring section 40, but provided at arcuately spaced intervals with relieved areas 66 forming vents for escape of air to permit cups to be telescoped together with facility as will be brought out shortly hereinafter.

Immediately below the indented locking section 64 is a depending cylindrical ring section 68 of substantially the same vertical height as the ring section 46 at the bottom of the outer cup member. The radial dimensions are such that the outer surface of an outer cup member ring 46 fits snugly against the inner surface of the inner cup member ring section 68, forming a substantially air tight seal therewith. At the bottom of the ring section 68 there is an inwardly directed ring 70 adapted to receive the lower edge shoulder 48 of a telescoped outer cup member, and therefore forming a stacking ring.

Below the stacking ring 70 there is a depending cylindrical ring section 72 of greater height than the ring section 62, terminated by an inwardly directed radial ring 74, and a dish portion 76 completing the inner cup member. The dish portion comprises a peripheral, somewhat parabolic or curved ring section 76 and a central, upwardly domed floor 78. As may well be seen in FIGS. 7 and 8 the outer portion of the floor 78 rests against the underlying portion of the floor 56 of the outer cup member, while the conical projection 58 at the center of the outer cup member reinforces the central portion of the floor 78. This reinforcement and also the upwardly domed shape prevent "oil canning" of the bottom end of the inner cup member when the cup is full of a liquid.

The dish portion 71 and the compartment 84 receive the food concentrate 80 or the like, generally in dry powder form, and which will dissolve in hot water poured into the cup. The food concentrate can be coffee powder, instant tea, dried chicken soup flakes, or anything else that is readily water soluble. It is not necessarily limited to a food stuff, and could be nonprescription medicines or pharmaceuticals, or even those on prescription, in appropriate circumstances. It could comprise a food coloring or dye material for instant coloring of Easter eggs, for example.

Each of the inner and outer cup members is of integral, one part construction. As previously indicated, the inner and outer cup members have their upper extremities rolled together to form a rim, and this secures the two cup members together to form the double-walled, insulated cup. The food concentrate or the like material 80 is placed in the bottom of each cup, and a large number of cups is stacked in nested, telescoped relation. In FIG. 8 an upper such cup is indicated as **20*a*, while a lower such cup telescoped with cup 20*a* is identified at 20*b*. As will be seen, the locking ring sections 46 and 66 of the cups 20*a* and 20*b* interfit to hold the bottom corner 48 of the cup 20*a* down against the stacking ring or shoulder 70 of the cup 20*b* with the outer sealing surface 46 of the cup 20*a* engaging the inner sealing surface 68 of the cup 20*b* over a substantial surface area, and thereby to maintain the compartment 84 formed between the lower end of the two cups 20*a* and 20*b* in substantially air tight condition, thereby to prevent contamination or spoilage of the food material 80 and to prevent creep of material 80 out of the compartment 84. It will be observed at the mutually engaging height of the sealing surfaces 46 and 68 is substantial and is a surface-to-surface seal, whereby slight vertical movement of the cups relative to one another will not break the seal. Furthermore, the interlocking ring sections 46 and 64 hold adjacent cups resiliently together, resisting such undesired movement. The locking ring sections require only one undercut apiece, thereby facilitating stripping of the respective cup members from their molds. Furthermore, as best will be observed in FIG. 8, the indentation formed by the ring 64 in the inner cup member is of lesser radial depth than the indentation formed by the locking ring 46** in the outer cup member, whereby direct radial forces are not presented between the two locking ring sections such as might tend to disturb the seal between the underlying sealing surfaces.

Furthermore, it will be noted that with the sealing rings or surfaces at the bottom of an outer cup member and adjacent the bottom of an inner cup member the air space above each bit of food material is relatively small, as is desirable for best storage of the food material. Futhermore, due to the suspension of the inner cup member within the outer cup member, and the radial spacing between walls of inner and outer cup members, the inner cup member may pivot somewhat at the lower end relative to the outer cup member, whereby the axis of a vertical stack of nested cups may be bowed somewhat, or otherwise bent from a straight line without destroying the seal between each pair of nested cups. Furthermore, the suspension of the inner cup member within the outer cup member, and the spacing between inner and outer cup member walls, combined with the step nature of the sidewalls of the cup members, provides a substantial axial resiliency to a stack of such cups. It has been found that axial resiliency is a necessary feature to prevent bursting open of pasteboard shipping containers if packages of the cups should be dropped, and it also is a highly important feature to prevent nested cups from being jammed together in such manner that they are difficult or impossible to separate.

When it is desired to separate cups, specifically to remove the lowest of the stack thereof, either manually, or by automatic means in a vending machine, the space radially outwardly of the locking ring 64 in the inner cup member is sufficient to allow flexing of the inner cup member in this area. Furthermore, the vent spaces 66 at this time facilitate movement of air into the space between the cups as indicated by the arrow 82 in FIG. 9. Conversely as previously described, the vent spaces also permit venting of air during stacking of cups.

The "food stuff" 80 need not actually be a food, but may be any human or animal ingestible material that is not harmful. Although reference has been made to dry material soluble in water, it is manifest that the material could be in some form other than dry, gelatinous for example, and the liquid would not necessarily be water, but could be any non-harmful liquid such as fruit juice, alcohol, etc., by way of example. The specific example of the invention as herein shown and described is for illustrative purposes only, and it will be understood that other forms of the invention will no doubt be comprehended by those skilled in the art, and will be understood as forming a part of the present invention insofar as they fall within the spirit and scope of the appended claims.

The invention is claimed as follows:

1. A double-wall thin wall plastic cup comprising inner and outer cup members each having a bottom transverse wall and a sidewall diverging upwardly therefrom to an open outer end, the sidewalls of said cup members being joined together adjacent said upper outer end and the inner cup member thereby being suspended substantially freely within said outer cup member, said inner cup member from its joinder with said outer cup member on down throughout a major portion of the vertical height thereof being substantially laterally spaced from and thereby being laterally substantially unrestrained by said outer cup member, said inner cup member having a circumferential sealing area of predetermined inner diameter and an adjacent inwardly projecting locking ring section above said sealing area and spaced a substantial distance down from said joinder, said outer cup member likewise having a circumferential sealing area spaced below said inner cup member sealing area and having an outer diameter substantially equal to said predetermined inner diameter and an adjacent inwardly projecting locking ring section above said outer cup member sealing area, the outer cup member locking ring section being substantially complimentary to the inner cup member locking ring section of a subjacent telescoped cup but projecting inwardly a greater distance than the locking ring section of said inner cup member to lock telescoped cups together with the sealing ring section of axially adjacent cups in sealing surface engagement providing a substantially sealed storage compartment at the bottom of an inner cup member of a subjacent pair of cups for receipt of a soluble substance, the suspension of said inner cup member and the absence of lateral restraint thereof by the outer cup member permitting deformation of the axis of a stack of cups and canting or pivoting of an inner cup member relative to an outer cup member without breaking of the seal between axially adjacent cups.

2. A cup as set forth in claim 1 wherein the joining of inner and outer cup members is effected by surface engagement and interlocked rolled upper rims.

3. A cup as set forth in claim 1 wherein there is only one locking ring section per cup member.

4. A cup as set forth in claim 3 wherein the locking ring section is relatively toward the bottom of each cup member.

5. A cup as set forth in claim 1 wherein the sidewall of said inner cup member is stepped to provide enhanced resiliency.

6. A cup as set forth in claim 1 wherein the bottom walls of the inner and outer cup members engage one another vertically for bracing of the bottom transverse wall of the inner cup member, said sidewalls adjacent said bottom walls being radially spaced.

7. A cup as set forth in claim 5 wherein the bottom walls of the inner and outer cup members engage one another vertically for bracing of the bottom transverse wall of the inner cup member, said sidewalls adjacent said bottom walls being radially spaced.

8. A cup as set forth in claim 1 wherein the inner cup member is provided with inwardly directed positive stop means engageable with a shoulder on the outer cup member of an upwardly adjacent cup to limit telescoping of adjacent cups.

9. A cup as set forth in claim 5 wherein the inner cup member is provided with inwardly directed positive stop means engageable with a shoulder on the outer cup member of an upwardly adjacent cup to limit telescoping of adjacent cups.

10. A cup as set forth in claim 6 wherein the inner cup member is provided with inwardly directed positive stop means engageable with a shoulder on the outer cup member of an upwardly adjacent cup to limit telescoping of adjacent cups.

11. A cup as set forth in claim 7 wherein the inner cup member is provided with inwardly directed positive stop means engageable with a shoulder on the outer cup member of an upwardly adjacent cup to limit telescoping of adjacent cups.

12. A cup as set forth in claim 1 wherein at least one of the locking ring sections of each cup is provided with vertical vent means for venting air from and to said storage compartment upon telescopic assembly and separation of adjacent cups.

13. A double-wall thin wall plastic cup comprising inner and outer cup members each having a bottom transverse wall and a sidewall extending upwardly therefrom to an open outer end, said outer cup member having a circumferential section extending upwardly of the sidewall a certain distance from the junction of the sidewall to the bottom wall thereof, a radially inwardly extending shoulder formed on the upper end of said circumferential section of said outer cup member, and said sidewall of said outer cup member diverging generally upwardly from said shoulder to said open outer end, said inner cup member having a circumferential section extending from adjacent the junction of the sidewall to the bottom wall thereof upwardly of the sidewall a certain distance greater than said certain distance of said circumferential section of said outer cup member and sufficiently great to define a storage space for a soluble substance within said inner cup member below the upper end of said circumferential section thereof, a radially outwardly extending shoulder formed on the upper end of said circumferential section of said inner cup member, a second circumferential section on the radially outward end of said shoulder of said inner cup member and extending upwardly therefrom, said second circumferential section having a height substantially equal to the height of said circumferential section of said outer cup member and an internal diameter substantially equal to the outer diameter of said circumferential section of said outer cup member, a radially inwardly extending circumferential groove formed on the upper end of said second circumferential section of said inner cup member and being circumferentially interrupted, said radially inwardly extending groove having a depth sufficient to produce a releasable interlock over said shoulder on said outer cup member when an outer cup member is axially inserted in said inner cup member, and said sidewall of said inner cup member diverging generally upwardly from said circumferential groove to said open outer end thereof, said inner cup member being positioned within said outer cup member and the upper ends of the sidewalls of said cup members being outwardly rim rolled together to support said inner cup member within said outer cup member from the upper end of said outer cup member, said bottom wall of said outer cup member being devoid of any axial interlock with the bottom wall of said outer cup member which permits relative axial and radial shifting of the bottom walls of said inner and outer cup members, and said sidewall of said inner cup member being devoid of any radial overlap with the sidewall of said outer cup member below the rolled rims which permits relative axial and radial shifting of said sidewalls of said inner and outer cup members below the rolled rims thereof.

* * * * *